US009145861B2

(12) United States Patent
Yamazaki et al.

(10) Patent No.: US 9,145,861 B2
(45) Date of Patent: Sep. 29, 2015

(54) ENGINE START CONTROL SYSTEM

(71) Applicant: SUZUKI MOTOR CORPORATION, Hamamatsu-shi, Shizuoka (JP)

(72) Inventors: Akinori Yamazaki, Hamamatsu (JP); Nobuyuki Shomura, Hamamatsu (JP); Kunitoshi Ito, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 187 days.

(21) Appl. No.: 13/846,101

(22) Filed: Mar. 18, 2013

(65) Prior Publication Data

US 2013/0247857 A1 Sep. 26, 2013

(30) Foreign Application Priority Data

Mar. 26, 2012 (JP) ..... 2012-070195

(51) Int. Cl.
*F02N 1/00* (2006.01)
*F02N 11/08* (2006.01)
(Continued)

(52) U.S. Cl.
CPC .. *F02N 1/00* (2013.01); *F02N 3/04* (2013.01); *F02N 11/0848* (2013.01);
(Continued)

(58) Field of Classification Search
CPC ..... F02D 2200/101; F02D 2200/704; F02N 1/00; F02N 2200/022; F02N 2250/02; F02N 11/04; F02N 11/0848; F02N 3/04
USPC ..... 123/179.3, 179.7, 179.14, 179.16, 123/185.2, 185.3, 436, 179.29, 599, 600, 123/601, 603; 701/103, 107, 110, 113; 73/114.25, 114.38, 114.59
See application file for complete search history.

(56) References Cited

U.S. PATENT DOCUMENTS 6,445,996 B1 * 9/2002 Corbeels et al. ..... 701/104
7,395,794 B2 * 7/2008 Tamamoto et al. ..... 123/179.28
(Continued)

FOREIGN PATENT DOCUMENTS

JP S6260963 A 3/1987
JP H06280666 A 10/1994
(Continued)

OTHER PUBLICATIONS

European Search Report dated Oct. 27, 2014, which issued during prosecution of European Application No. 13158609.1, which corresponds to the present application.
(Continued)

*Primary Examiner* — Lindsay Low
*Assistant Examiner* — Garrett M Hausman
(74) *Attorney, Agent, or Firm* — Troutman Sanders LLP

(57) ABSTRACT

When an ECM activates as powered from a generator, a decision unit determines occurrence of instantaneous interruption and reactivation of the ECM, if engine speed detected by an engine speed sensor immediately after activation of the ECM is found to be not smaller than a predetermined number of rotation Y. When occurrence of the instantaneous interruption and reactivation is actually determined, the ECM terminates operation of the engine. On the other hand, if occurrence of the instantaneous interruption and reactivation is not determined, the ECM detects, using a maximum value detection unit, a maximum value of pressure in the intake pipe detected by a pressure sensor, within a predetermined range of crank angle after activation of the ECM, stores the maximum value into a memory for later use as the atmospheric pressure, and uses it for control of fuel injection by an injector.

3 Claims, 6 Drawing Sheets

(51) Int. Cl.
*F02N 3/04* (2006.01)
*F02N 11/04* (2006.01)

(52) U.S. Cl.
CPC .... *F02D 2200/101* (2013.01); *F02D 2200/704* (2013.01); *F02N 11/04* (2013.01); *F02N 2200/022* (2013.01); *F02N 2250/02* (2013.01)

(56) References Cited

U.S. PATENT DOCUMENTS

| | | | | |
|---|---|---|---|---|
| 2009/0198436 | A1 | 8/2009 | Sasaki | |
| 2009/0319106 | A1 | 12/2009 | Ichikawa et al. | |
| 2010/0018189 | A1 * | 1/2010 | Oi et al. | 60/290 |
| 2011/0073077 | A1 * | 3/2011 | Yamaguchi et al. | 123/491 |

FOREIGN PATENT DOCUMENTS

| | | | |
|---|---|---|---|
| JP | 11-247706 | A | 9/1999 |
| JP | 2008280886 | A | 11/2008 |
| JP | 2011069297 | A | 4/2011 |
| WO | 2008/081281 | | 7/2008 |

OTHER PUBLICATIONS

Office Action issued in corresponding Japanese Patent Application No. 2012-070195, having a mail date of Jun. 30, 2015.

* cited by examiner

ENGINE START CONTROL SYSTEM

CROSS-REFERENCE TO RELATED APPLICATIONS

This application is based upon and claims the benefit of priority of the prior Japanese Patent Application No. 2012-070195, filed on Mar. 26, 2012, the entire contents of which are incorporated herein by reference.

BACKGROUND OF THE INVENTION

1. Field of the Invention

The present invention relates to an engine start control system which is convenient when used for manually starting an engine with the aid of a recoil starter or the like.

2. Description of the Related Art

Some types of engines used for outboard motor employ an ECM (Engine Control Module) for controlling fuel injection by an injector. The ECM in this case is configured to use the atmospheric pressure as one parameter for regulating the fuel injection.

Patent Document 1 discloses a configuration aimed at detecting the atmospheric pressure without using the atmospheric pressure sensor, wherein the atmospheric pressure is detected by a pressure sensor for detecting air pressure in an intake pipe, based on a pressure detection signal of the pressure sensor detected when the control unit (ECM) is powered ON, while a crankshaft stays still.

In particular, marine vessels hardly encounter a situation such that the atmospheric pressure sharply changes (for example, travel towards highlands) in a single operation, so that information of the atmospheric pressure only at the start of operation will suffice. Accordingly, there will be no need of equipping a dedicated atmospheric pressure sensor, if the atmospheric pressure may be known from the pressure in the intake pipe as described in Patent Document 1, and this will give a large cost merit. [Patent Document 1] Japanese Laid-Open Patent Publication No. H11-247706

The configuration described in Patent Document 1 is, however, premised on installing a battery. In a configuration without the battery, the ECM will be activated as powered from a generator which operates in association with rotation of a crankshaft of the engine. In other words, the ECM will not be activated unless the crankshaft rotates, so that it is unable to detect the atmospheric pressure based on the pressure detection signal of the pressure sensor, when the crankshaft stays still, as described in Patent Document 1.

For the configuration without the battery, there is now one possible idea of determining the atmospheric pressure, by detecting the maximum value of pressure in the intake pipe, when the ECM is powered from the manually-cranked generator at the starting using the recoil starter. In the manually cranking, that is, in a period before the engine starts to rotate under its own power, the pressure in the intake pipe becomes negative relative to the atmospheric pressure in the intake process, and peaks at the time of switching from the exhaust process to the intake process, showing the maximum value almost coincides with the atmospheric pressure.

By the way, electric power generation by the generator sharply decreases when engine speed decreases particularly in low speed region. The engine speed also decreases in the compression process. For this reason, only with a weak force of pulling of the recoil starter, the ECM would once activate as powered from the manually cranked generator, but would stop in the compression process since the power generation would decrease due to lowered engine speed. On the other hand, even under such extremely low speed, the engine restarts if combustion occurs (first explosion) in a specified timing beyond the compression dead top center. As a consequence, the power generation of the generator elevates again, and the ECM reactivates. As described in the above, an event encountered herein is that the ECM is once activated, then stops, and is reactivated as triggered by first explosion. In this specification, the event will be referred to as "instantaneous interruption and reactivation" of ECM, hereinafter.

For the case where the instantaneous interruption and reactivation of ECM occurs, the reactivated ECM will determine the atmospheric pressure by detecting a maximum value of pressure in the intake pipe after the engine began to rotate under its own power. However, after the engine began to rotate under its own power, the pressure in the intake pipe, and even the maximum value thereof, becomes negative relative to the atmospheric pressure, showing no agreement with the atmospheric pressure.

SUMMARY OF THE INVENTION

With the issues described in the above, the present invention was conceived and an object of which is to avoid a nonconformity such that, in the process of starting using a recoil starter, instantaneous interruption and reactivation of the ECM occurs, and thereby the engine is for example kept operated under the atmospheric pressure falsely detected.

According to the present invention, there is provided an engine start control system which includes a manual starter which allows manual rotation of a crankshaft of an engine; a generator which operates in association with rotation of the crankshaft; an electronic fuel injector which feeds a fuel to the engine; an engine control device which operates using electric power generated by the generator, and controls the electronic fuel injector; and an engine speed detection section which detects engine speed. The engine control device includes a decision section which detects occurrence of instantaneous interruption and reactivation of the engine control device in the process of starting using the manual starter, based on the engine speed detected by the engine speed detection unit.

According to another aspect of the present invention, there is provided the engine start control system, wherein the decision section determines occurrence of the instantaneous interruption and reactivation, if engine speed detected by the engine speed detection unit after activation of the engine control device is not smaller than a predetermined speed.

According to another aspect of the present invention, there is provided the engine start control system which further includes a pressure detection section which detects pressure in an intake pipe of the engine, and the engine control device includes a maximum value detection section which detects a maximum value of pressure in the intake pipe detected by the pressure detection section, within a predetermined range of crank angle after activation of the engine control device.

According to another aspect of the present invention, there is provided the engine start control system, wherein the engine control device terminates operation of the engine, if the decision section determines occurrence of the instantaneous interruption and reactivation.

According to another aspect of the present invention, there is provided the engine start control system, wherein, if the decision section determines occurrence of the instantaneous interruption and reactivation, the engine control device uses, as the atmospheric pressure, a maximum value of pressure in the intake pipe, which is detected by the maximum value detection section at the first activation of the engine control device in the process of instantaneous interruption and reactivation.

DETAILED DESCRIPTION OF THE PREFERRED EMBODIMENTS

Preferred embodiments of the present invention will be explained, referring to the attached drawings.

First Embodiment

Figure 1:
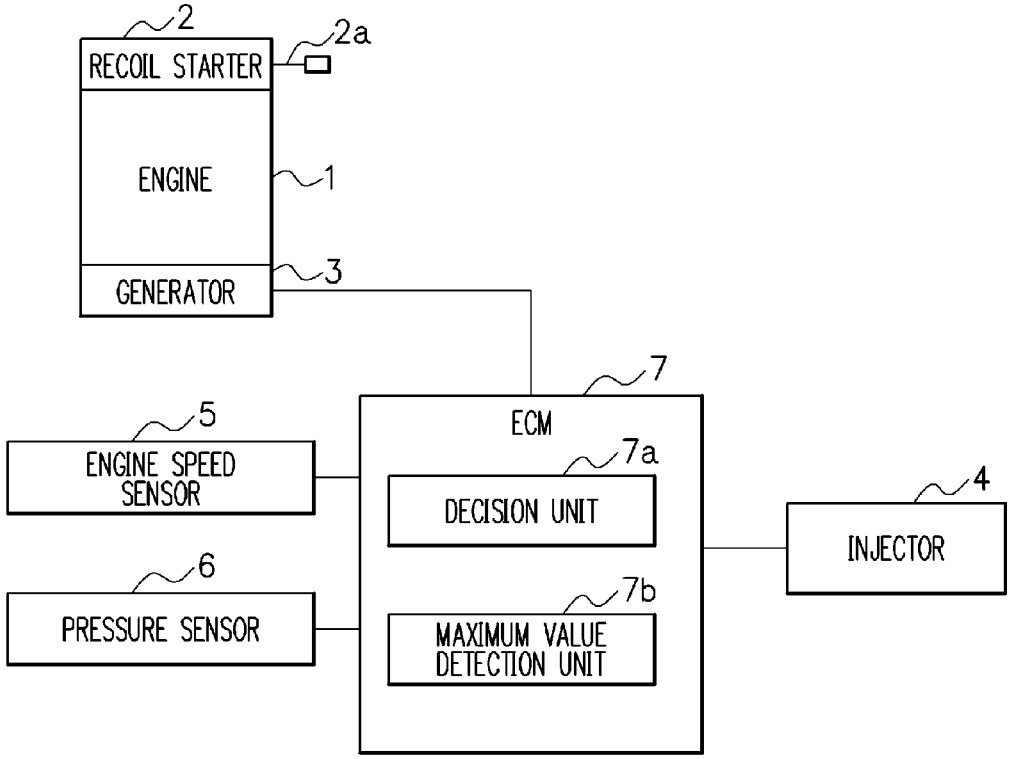
FIG. 1 is a drawing illustrating a schematic configuration of an engine start control system of a first embodiment.

FIG. 1 is a drawing illustrating a schematic configuration of an engine start control system of this embodiment. Note that FIG. 1 only illustrates constituents around the engine and the ECM necessary for applying the present invention, leaving the other constituents not illustrated.

Reference numeral 1 denotes an engine as an internal combustion engine.

Reference numeral 2 denotes a recoil starter which functions as a manual starter, configured to induce rotation of a crankshaft of the engine 1, by pulling by hand a rope 2*a* wound around a pulley.

Reference numeral 3 denotes a generator which is driven by rotation of the crankshaft of the engine 1.

Reference numeral 4 denotes an injector which functions as an electronic fuel injector, and is attached to an intake pipe of the engine 1. The injector 4 feeds a fuel, fed from an unillustrated fuel pump, by injecting it into the intake pipe, according to a driving signal received from an ECM 7.

Reference numeral 5 denotes an engine speed sensor which functions as an engine speed detection section, and detects engine speed based on time necessary to reach a predetermined crank angle.

Reference numeral 6 is a pressure sensor which functions as a pressure detection section, and detects pressure in the intake pipe on the downstream side of a throttle valve of the intake pipe.

Reference numeral 7 denotes an ECM which functions as an engine control device, and is configured by a CPU, a RAM, a ROM and so forth which function as a decision unit 7*a*, and a maximum value detection unit 7*b*. The decision unit 7*a* determines occurrence of the instantaneous interruption and reactivation of the ECM 7 in the process of starting by the recoil starter 2, based on engine speed detected by the engine speed sensor 5. The maximum value detection unit 7*b* detects a maximum value of pressure in the intake pipe detected by the pressure sensor 6, within a predetermined range of crank angle after activation of the ECM 7. The ECM 7 operates while being powered by the generator 3.

Figure 2A:
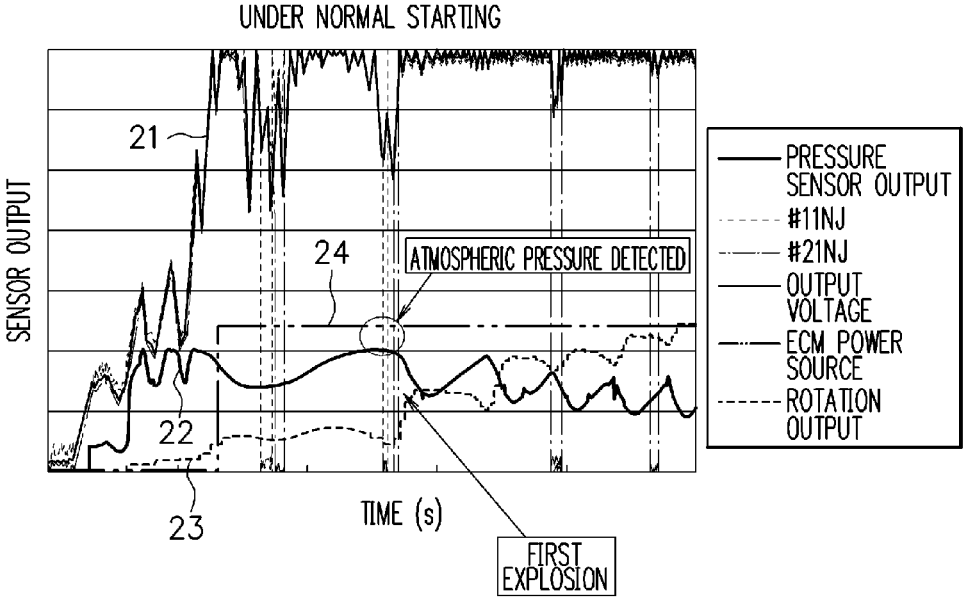
FIGS. 2A and 2B are drawings illustrating characteristics of generated voltage of a generator in the process of starting using a recoil starter, pressure in an intake pipe, engine speed, and an ECM power source, wherein FIG. 2A corresponds to characteristics under normal starting, and FIG. 2B corresponds to characteristics under occurrence of the instantaneous interruption and reactivation.
Figure 2B:
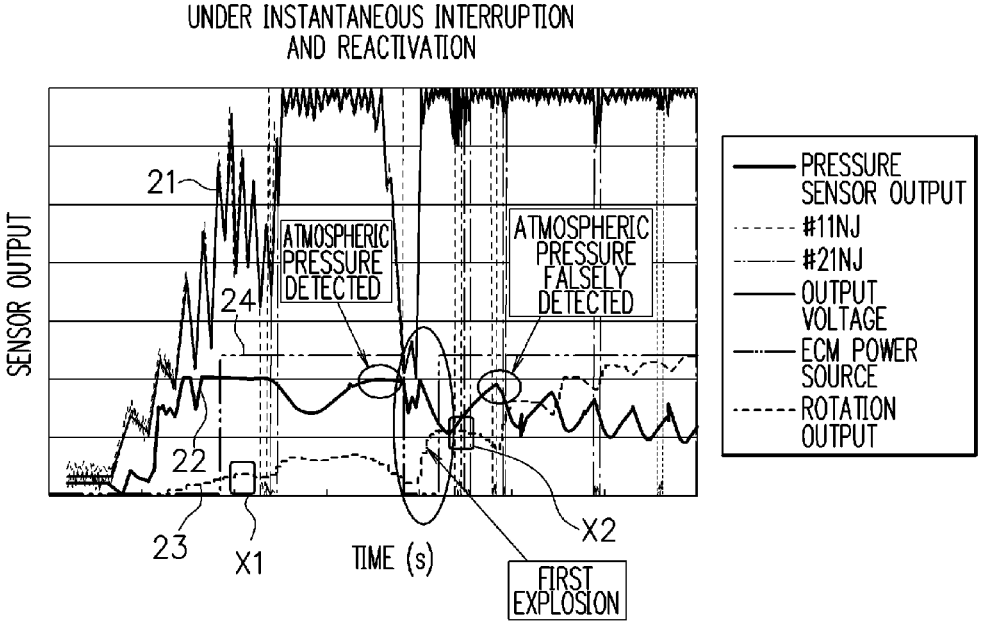

Detection of the atmospheric pressure and the instantaneous interruption and reactivation of the ECM 7 will be explained referring to FIGS. 2A and 2B. FIGS. 2A and 2B are drawings illustrating characteristics of generated voltage of the generator (output voltage of the generator 3) in the process of starting using a recoil starter 2, pressure in the intake pipe (output of the pressure sensor 6), engine speed (rotation output of the engine speed sensor 5), and an ECM power source, wherein FIG. 2A corresponds to characteristics under normal starting, and FIG. 2B corresponds to characteristics under occurrence of the instantaneous interruption and reactivation.

As indicated by a characteristic curve 23 in FIG. 2A, the engine speed appears as a result of manually cranking in the process of starting using the recoil starter 2. In association therewith, the generator 3 operates to elevate the voltage generation as indicated by a characteristic curve 21. When the voltage generation of the generator 3 exceeds a predetermined level, the ECM 7 activates as indicated by a characteristic curve 24. When combustion occurs thereafter as a result of ignition in a specified timing beyond the compression dead top center (first explosion), the engine 1 starts to thereby elevate the engine speed.

Now, in the manually cranking, that is, in a period before the engine starts to rotate under its own power, the pressure in the intake pipe becomes negative relative to the atmospheric pressure in the intake process, as indicated by a characteristic curve 22, and peaks at the time of switching from the exhaust process to the intake process, showing the peak value almost coincides with the atmospheric pressure. Accordingly, the maximum value (which may be the maximum value per se, or may be an average value over a peak area) of pressure in the intake pipe, before the engine 1 begins to rotate under its own power, may be used as the atmospheric pressure. Note that the pressure in the intake pipe, once the engine 1 began to rotate under its own power, the pressure in the intake pipe becomes negative relative to the atmospheric pressure, also the maximum value thereof does not reach the atmospheric pressure, rather than coming into agreement with the atmospheric pressure.

Figure 3:
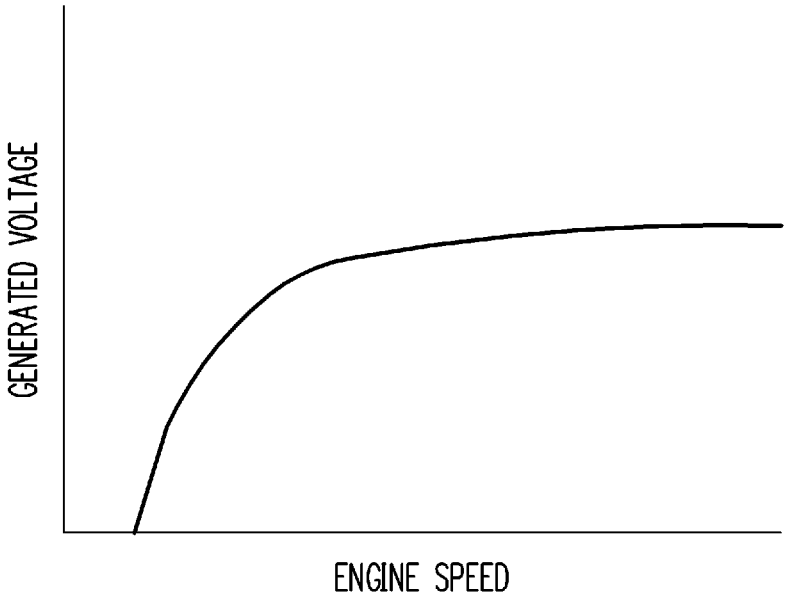
FIG. 3 is a characteristic drawing illustrating a relation between engine speed and generated voltage by the generator.

By the way, the generated voltage by the generator 3 sharply decreases due to lowered engine speed, particularly in the low speed region (see FIG. 3). The engine speed also decreases in the compression process. For this reason, only with a weak force of pulling of the recoil starter, the ECM 7 would once activate as powered from the manually cranked generator 3 as illustrated in FIG. 2B, but would stop in the compression process since the power generation would decrease due to lowered engine speed. On the other hand, even under such extremely low speed, the engine 1 restarts if combustion occurs (first explosion) in a specified timing beyond the compression dead top center. As a consequence, the power generation of the generator 3 elevates again, and the ECM 7 reactivates. As described in the above, an event encountered herein is that the ECM 7 is once activated (first activation), then stops, and is reactivated as triggered by first explosion, which is referred to as instantaneous interruption and reactivation.

When the instantaneous interruption and reactivation of the ECM 7 thus occurred, the reactivated ECM 7 will determine the atmospheric pressure by detecting the maximum value of pressure in the intake pipe after the engine began to rotate under its own power. However, the pressure in the intake pipe after the engine 1 began to rotate under its own power is not equal to the atmospheric pressure, so that the atmospheric pressure is falsely detected as a consequence.

Then, occurrence of the instantaneous interruption and reactivation of the ECM 7 in the process of starting using the recoil starter 2 is determined as detailed below. Occurrence of the instantaneous interruption and reactivation of the ECM 7 may be determined by engine speed detected by the engine speed sensor 5.

Figure 4:
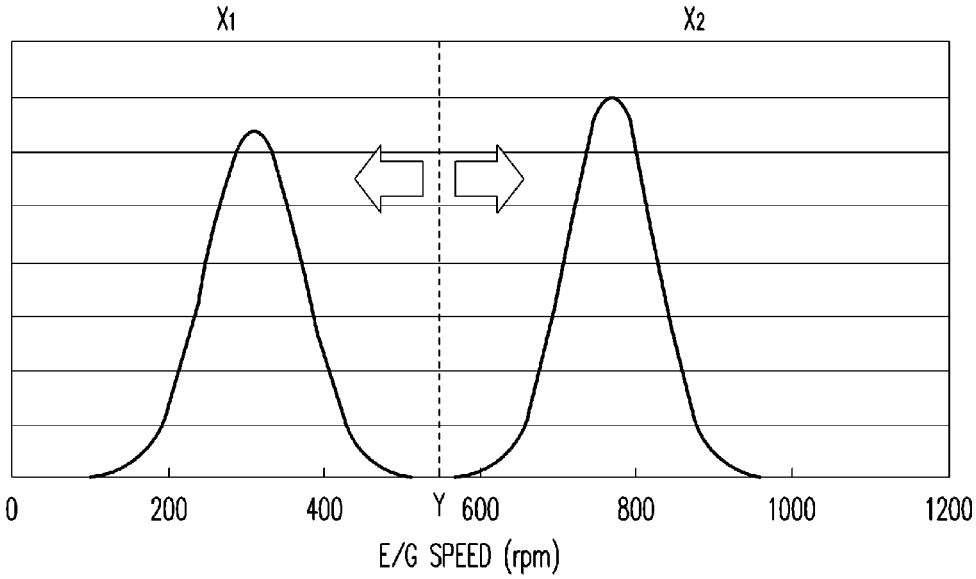
FIG. 4 is a normal distribution chart illustrating instantaneous engine speed immediately after activation of an ECM (first activation, reactivation) when instantaneous interruption and reactivation occurred.
Figure 5:
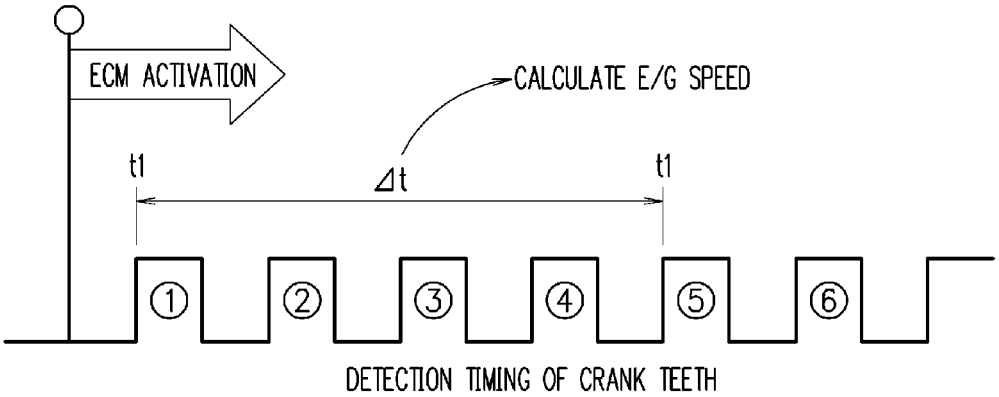
FIG. 5 is a drawing explaining an outline of calculation of engine speed.

FIG. 4 illustrates a normal distribution of instantaneous engine speed of the engine 1 immediately after the first activation of the ECM 7 (X1 in FIG. 2B), and a normal distribution of instantaneous engine speed of the engine 1 immediately after the reactivation (X2 in FIG. 2B), when the instantaneous interruption and reactivation occurred. As illustrated in FIG. 5, the engine speed is calculated based on the time necessary to reach a predetermined crank angle (in the illustrated example, it is 40° which corresponds to 4 cycles of crank angle signal at 10° intervals). The engine speed immediately after activation of the ECM 7 largely varies between the engine speed ascribable to manually cranking (X1 in FIG. 2) and the engine speed ascribable to rotation of the engine 1 under its own power (X2 in FIG. 2). While the engine speed during manually cranking is in a relatively slow area, the engine speed during rotation of the engine 1 under its own power is in a relatively fast area.

Conversely, occurrence of the instantaneous interruption and reactivation of the ECM 7 may be determined, by setting a predetermined number of rotation Y, and if the engine speed detected by the engine speed sensor 5 immediately after activation of the ECM 7 is found to be not smaller than the number of rotation Y.

Figure 6:
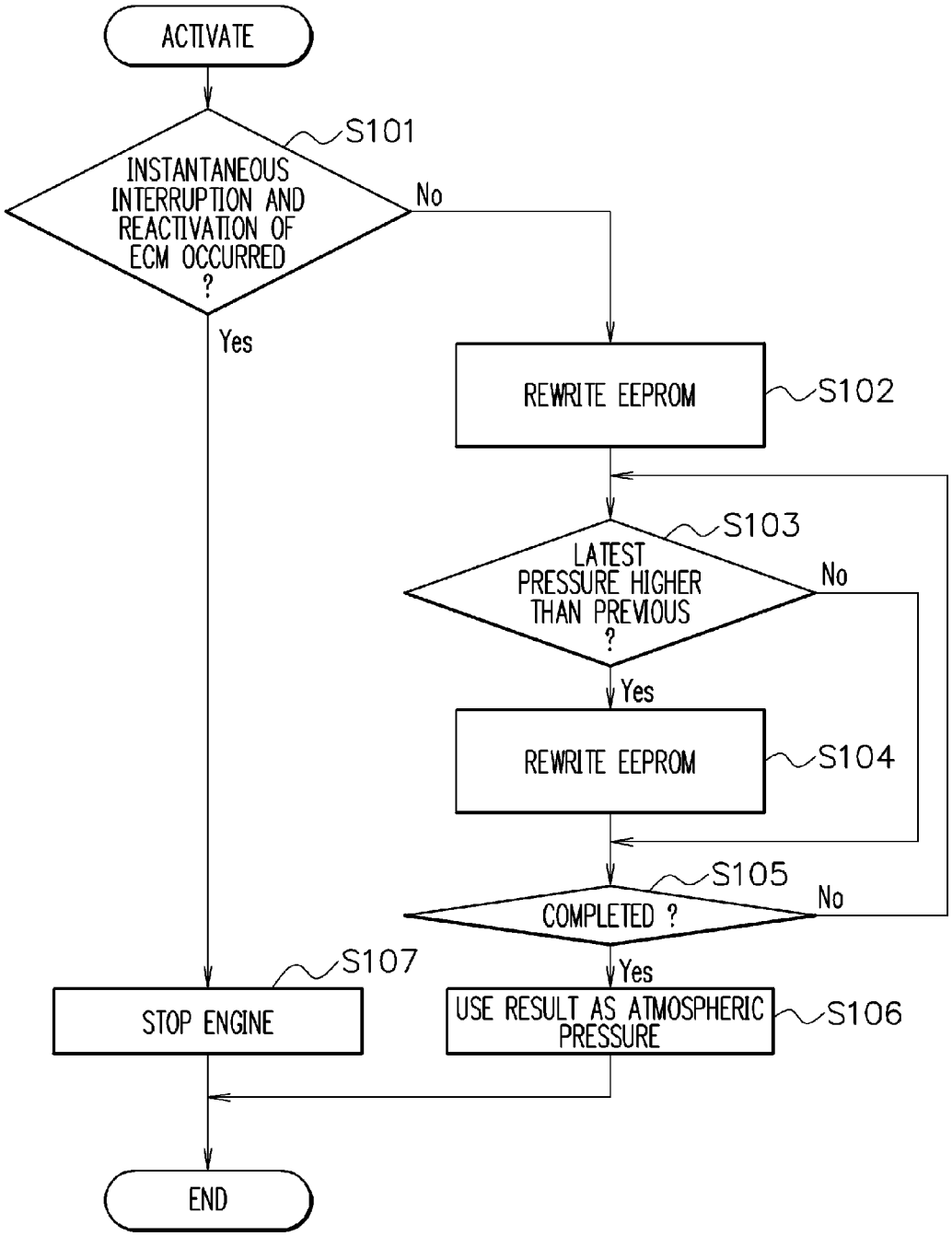
FIG. 6 is a flow chart illustrating processing action executed by the ECM of a first embodiment.

FIG. 6 illustrates processing action executed by the ECM 7 in this embodiment.

As illustrated in FIG. 6, when the ECM 7 activates as powered from the generator 3, the decision unit 7*a* determines occurrence of the instantaneous interruption and reactivation of the ECM 7, based on the engine speed detected by the engine speed sensor 5 immediately after the activation (step S101). As described in the above, occurrence of the instantaneous interruption and reactivation of the ECM 7 is determined, when the engine speed detected by the engine speed sensor 5 immediately after activation of the ECM 7 is found to be not smaller than the predetermined number of rotation Y.

When the instantaneous interruption and reactivation is found to occur, the ECM 7 stops operation of the engine 1 (step S107). The instantaneous interruption and reactivation of the ECM 7 occur only when the recoil starter is pulled by a very small force. While the engine hardly starts in most cases, it rarely starts as triggered by the first explosion beyond the compression dead top center. Since the engine in this embodiment is immediately stopped when occurrence of the instantaneous interruption and reactivation is determined, so as to allow the user to recognize that he or she failed in starting the engine due to insufficient force of pulling the recoil starter, without making them feel something wrong.

On the other hand, if the instantaneous interruption and reactivation is not determined, the ECM 7 detects, using the maximum value detection unit 7*b*, a maximum value of pressure in the intake pipe detected by the pressure sensor 6, within a predetermined range of crank angle after activation of the ECM 7. More specifically, an EEPROM in the ECM 7 is rewritten with data of pressure in the intake pipe detected for the first time by the pressure sensor 6 (step S102). Thereafter, until a predetermined level of crank angle is reached, the EEPEOM is rewritten with data of pressure in the intake pipe sequentially detected by the pressure sensor 6, only when the newly detected pressure is higher than the already stored pressure (steps S103 to S105). For example, a moving average value of the pressure in the intake pipe may be determined for every detection cycle, and the EEPROM may be rewritten only when a moving average value of the pressure in the intake pipe in the latest detection cycle is higher than the moving average value already stored in the EEPROM. In this way, the EEPROM will have stored therein a maximum value of pressure in the intake pipe, within a predetermined range of crank angle after the activation. The ECM 7 then stores the maximum value of pressure in the intake pipe stored in the EEPROM into a memory for later use as the atmospheric pressure, and uses it for control of fuel injection by the injector 4 (step S106). Note that use of the maximum value of pressure in the intake pipe as the atmospheric pressure include not only an exemplary case where the maximum value per se is used as the atmospheric pressure, but also an exemplary case where the maximum value subjected to a predetermined correction is used as the atmospheric pressure.

As described in the above, in the process of starting using the recoil starter 2, occurrence of the instantaneous interruption and reactivation of the ECM 7 is determined, and if the occurrence is determined, operation of the engine 1 is terminated. In this way, it becomes possible to avoid a nonconformity such that the engine is kept operated under the atmospheric pressure falsely detected.

Second Embodiment

While the ECM in the first embodiment terminates operation of the engine under occurrence of instantaneous interruption and reactivation of the ECM is detected, whereas in this embodiment, operation of the engine 1 is allowed to continue. Since the system configuration and basic processing actions are same as those in the first embodiment, so that the description below will mainly deal with aspects different from those in the first embodiment.

Figure 7:
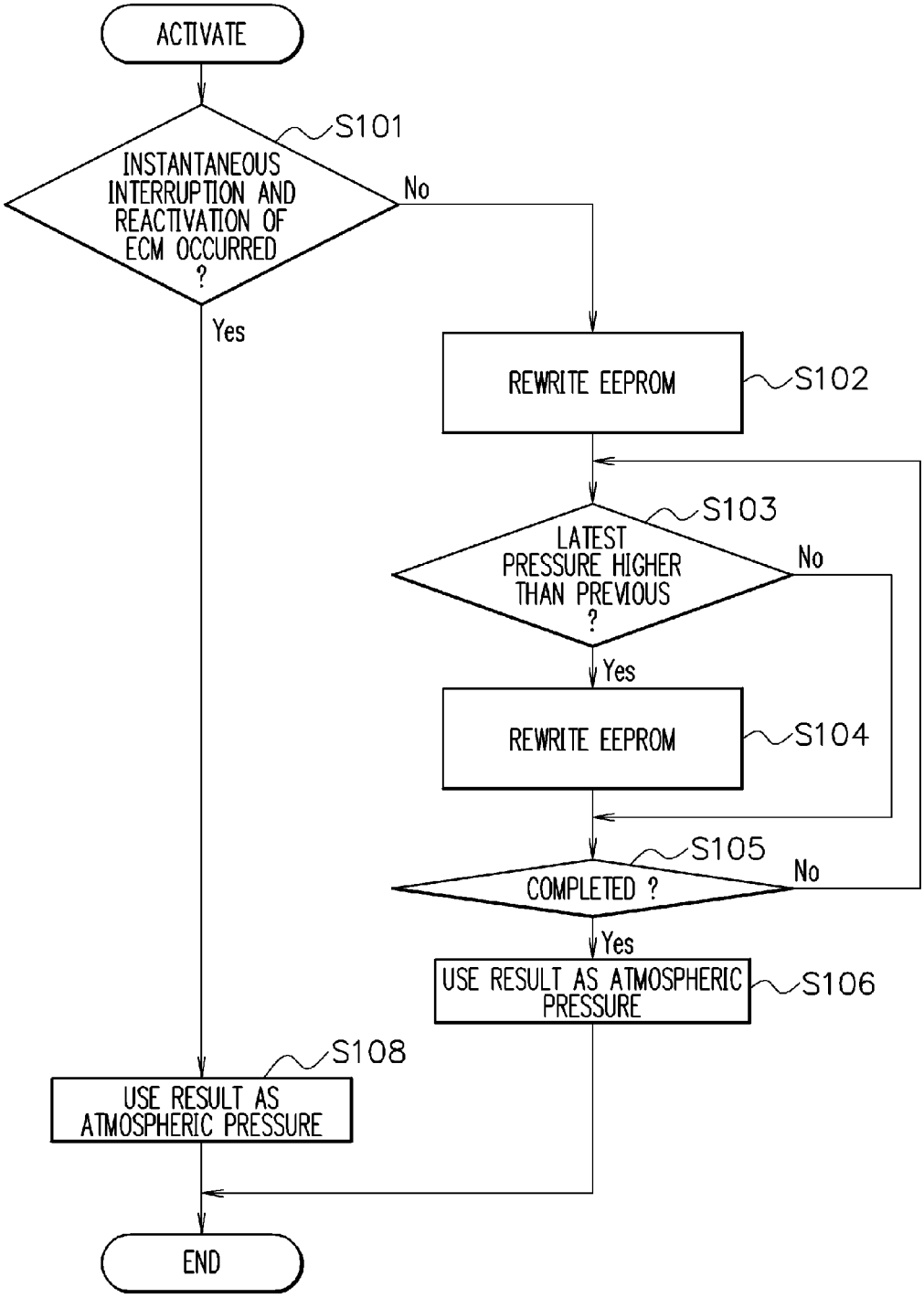
FIG. 7 is a flow chart illustrating processing action executed by the ECM of a second embodiment.

FIG. 7 illustrates processing action executed by the ECM in this embodiment. Processes in steps S101 to S106 are same as those in the first embodiment, and will not be explained again.

When occurrence of the instantaneous interruption and reactivation is determined, the ECM 7 uses the pressure stored in the EEPROM as the atmospheric pressure (step S108). The pressure data stored in the EEPROM is a maximum value of pressure in the intake pipe before reactivation of the ECM 7, that is, in the process of first activation of the ECM 7. As described in the above, once the engine 1 began to rotate under its own power, the pressure in the intake pipe becomes negative relative to the atmospheric pressure, and also the maximum value thereof does not reach the atmospheric pressure. The maximum value of pressure in the intake pipe before reactivation of the ECM 7, that is, in the process of first activation of the ECM 7 may be used as the atmospheric pressure.

As described in the above, in the process of starting using the recoil starter 2, occurrence of the instantaneous interruption and reactivation of the ECM 7 is determined, and if the occurrence is actually determined, the engine 1 is kept operated, and the maximum value of the pressure in the intake pipe in the process of the first activation of the ECM 7 (in the manually cranking) may be used as the atmospheric pressure. In this way, it becomes possible to avoid a nonconformity such that the engine is kept operated under the atmospheric pressure falsely detected.

Having described the present invention referring to the preferable embodiments, the present invention is not limited to these embodiment, and may be modified in various ways without departing from the scope of the present invention.

According to the present invention, occurrence of the instantaneous interruption and reactivation of the engine control device may be determined in the process of starting using the manual starter. In this way, it becomes possible to avoid a nonconformity such that the engine is kept operated under the atmospheric pressure falsely detected.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An engine start control system comprising:

a manual starter which allows manual rotation of a crankshaft of an engine;

a generator which operates in association with rotation of the crankshaft;

an electronic fuel injector which feeds a fuel to the engine;

an engine control device which operates using electric power only generated by the generator, and controls the electronic fuel injector; and an engine speed detection section which detects an engine speed, wherein the engine control device comprises a decision section which detects occurrence of instantaneous interruption and reactivation of the engine control device in the process of starting using the manual starter, based on the engine speed detected by the engine speed detection unit, wherein the decision section determines occurrence of the instantaneous interruption and reactivation, if the engine speed detected by the engine speed detection unit after activation of the engine control device is not smaller than an idling speed, which is a speed at which the engine starts to rotate under its own power, and wherein the engine control device terminates operation of the engine, if the decision section determines occurrence of the instantaneous interruption and reactivation.

2. The engine start control system according to claim 1, further comprising a pressure detection section which detects pressure in an intake pipe of the engine, and the engine control device comprises a maximum value detection section which detects a maximum value of pressure in the intake pipe detected by the pressure detection section, within a predetermined range of crank angle after activation of the engine control device.

3. The engine start control system according to claim 2, wherein, if the decision section determines occurrence of the instantaneous interruption and reactivation, the engine control device uses, as the atmospheric pressure, a maximum value of pressure in the intake pipe, which is detected by the maximum value detection section at the first activation of the engine control device in the process of instantaneous interruption and reactivation.

* * * * *